US006196035B1

(12) United States Patent
Tsui

(10) Patent No.: US 6,196,035 B1
(45) Date of Patent: Mar. 6, 2001

(54) DOOR LOCK ASSEMBLY HAVING AN AUTOMATICALLY ACTUATED LATCH MECHANISM

(76) Inventor: Kai-Liang Tsui, 6F, No. 56, Pao-Sheng Rd., Yunho City, Taipei Hsien (TW)

( * ) Notice: Subject to any disclaimer, the term of this patent is extended or adjusted under 35 U.S.C. 154(b) by 0 days.

(21) Appl. No.: 09/368,258

(22) Filed: Aug. 3, 1999

(51) Int. Cl.[7] ..... E05B 59/04

(52) U.S. Cl. ..... 70/107; 70/352; 70/486; 292/333

(58) Field of Search ..... 70/107, 110, 111, 70/141, 143, 352, 486; 292/332, 333, 335, 150, 336

(56) References Cited

U.S. PATENT DOCUMENTS

| | | | | |
|---|---|---|---|---|
| 361,247 | * | 4/1887 | Winchester | 292/333 |
| 1,816,134 | * | 7/1931 | Wood | 292/333 |
| 3,266,276 | * | 8/1966 | Yulkowski | 70/110 |
| 4,262,504 | * | 4/1981 | Inoue | 292/333 X |
| 4,561,684 | * | 12/1985 | Marotto | 292/333 X |
| 4,890,870 | * | 1/1990 | Miron | 292/333 |
| 4,950,005 | * | 8/1990 | Cudd | 292/333 X |

FOREIGN PATENT DOCUMENTS

| | | | | |
|---|---|---|---|---|
| 629235 | * | 4/1936 | (DE) | 292/333 |
| 171210 | * | 10/1951 | (DE) | 292/333 |
| 2912881 | * | 10/1980 | (DE) | 292/333 |
| 376968 | * | 7/1932 | (GB) | 292/333 |
| 2039983 | * | 8/1980 | (GB) | 292/335 |
| 43998 | * | 8/1938 | (NL) | 70/111 |

* cited by examiner

*Primary Examiner*—Lloyd A. Gall
(74) *Attorney, Agent, or Firm*—Lackenbach Siegel Marzullo Aronson & Greenspan

(57) ABSTRACT

A door lock assembly includes a hollow casing, a latch, an actuator rod, and a drive mechanism. The casing has left and right side walls that are opposite to one another, and a rear wall interconnecting the left and right side walls. The left side wall has upper and lower openings formed therein. The latch is mounted movably in the casing in a latching direction between a latched position for allowing extension of the latch out of the casing via the upper opening and an unlatched position for allowing retraction of the latch into the casing. The actuator rod is disposed below the latch, and is movable in the casing along a direction parallel to the latching direction between an extended position outwardly of the casing via the lower opening and a retracted position. The actuator rod has an actuating element formed thereon, and a coiled spring for urging the actuator rod to the extended position. The drive mechanism is actuated by the actuating element when the actuator rod is moved to the retracted position against a spring force of the coiled spring for driving the latch to the latched position.

9 Claims, 13 Drawing Sheets

DOOR LOCK ASSEMBLY HAVING AN AUTOMATICALLY ACTUATED LATCH MECHANISM

BACKGROUND OF THE INVENTION

1. Field of the Invention

This invention relates to a door lock assembly, more particularly to a door lock assembly having an automatically actuated latch mechanism.

2. Description of the Related Art

It is known that a conventional door lock assembly has a casing that is provided typically with a spring-biased latch bolt and a dead bolt. The latch bolt is retractable into the casing against a spring force when a compression force is exerted on the latched bolt, and can extend out from the casing when the compression force is released. The dead bolt is operable to extend from or retract into the casing by means of a key. In use, the latch bolt extends into a first corresponding socket formed in a doorframe when a door is closed. However, unless the user actuates the dead bolt by using the key, the dead bolt will not extend into a second corresponding socket formed in the doorframe to lock the door to the doorframe when the door is closed. This inconveniences the user, especially when the user does not have a free hand to manipulate the key.

SUMMARY OF THE INVENTION

The object of the present invention is to provide a door lock assembly having a latch that can be actuated to lock a door to a doorframe when the door is closed.

According to the present invention, the door lock assembly comprises a hollow casing, a latch, an actuator rod, and a drive mechanism. The casing has left and right side walls that are opposite to one another, and a rear wall interconnecting the left and right side walls. The left side wall has upper and lower openings formed therein. The latch is mounted movably in the casing in a latching direction between a latched position for allowing extension of the latch out of the casing via the upper opening and an unlatched position for allowing retraction of the latch into the casing. The actuator rod is disposed below the latch and is movable in the casing along a direction parallel to the latching direction between an extended position outwardly of the casing via the lower opening and a retracted position. The actuator rod has an actuating element formed thereon, and a coiled spring for urging the actuator rod to the extended position. The drive mechanism is actuated by the actuating element when the actuator rod is moved to the retracted position against a spring force of the coiled spring for driving the latch to the latched position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
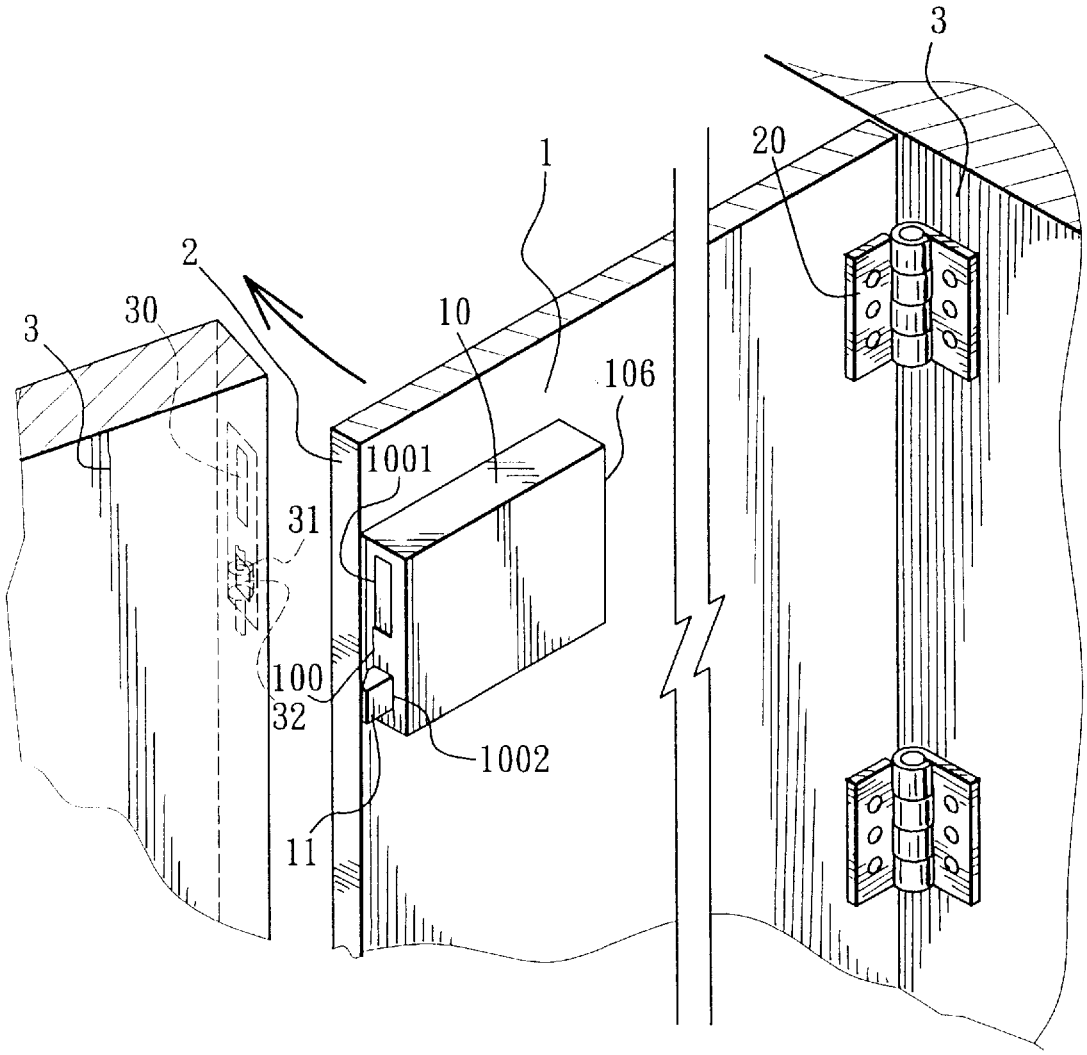
FIG. 1 is a schematic view of a preferred embodiment of a door lock assembly according to the present invention, in which the door lock assembly is mounted on a door.
Figure 2:
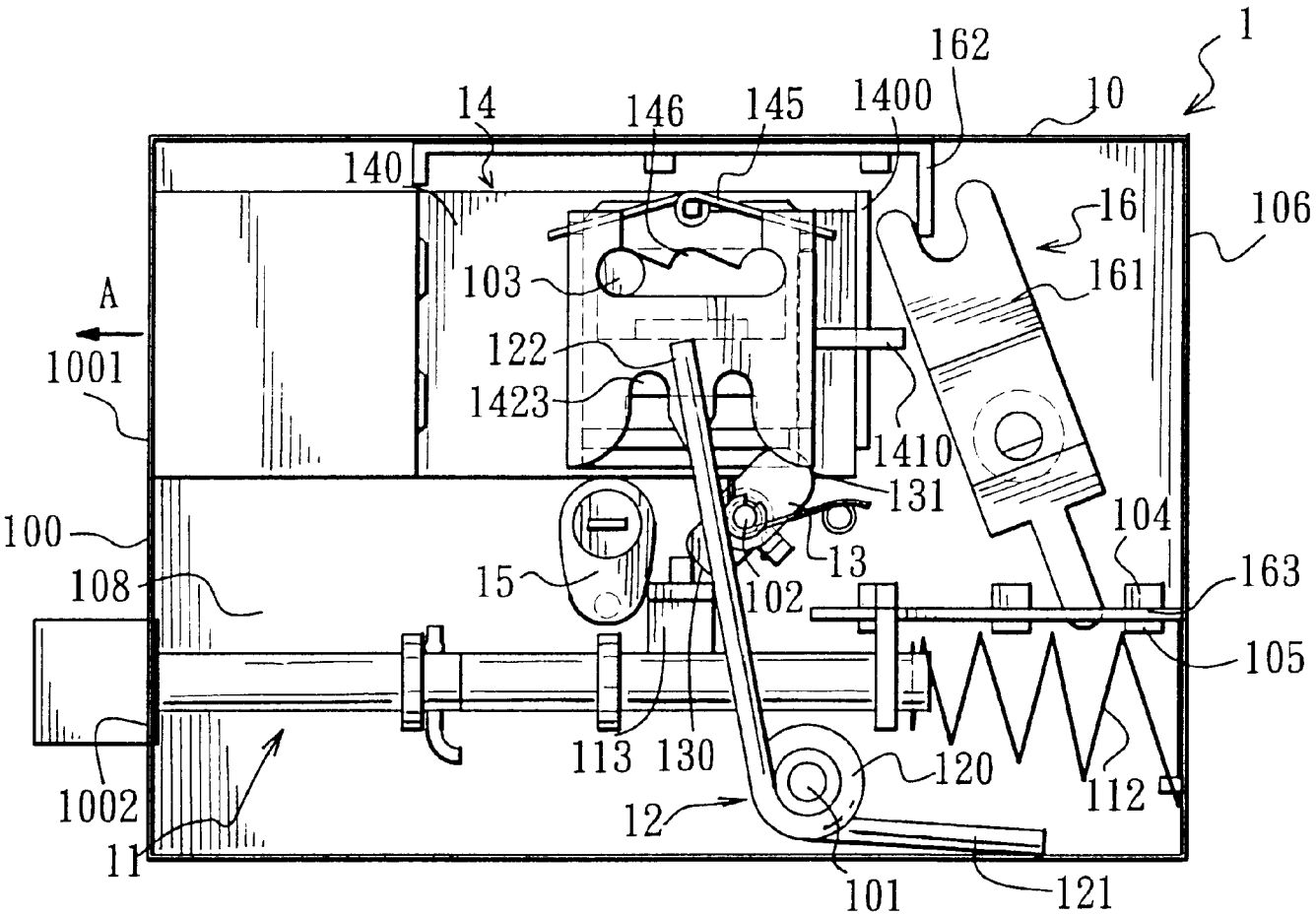
FIG. 2 is a side planar view of the preferred embodiment of the door lock assembly according to the present invention.

Referring to FIGS. 1 and 2, a preferred embodiment of a door lock assembly 1 according to the present invention is shown to comprise a hollow casing 10, a latch 14 and an actuator 11. The casing 10 is mounted on a door 2 that is connected pivotally to a doorframe 3 by hinge members 20. The doorframe 3 has an upper socket 30 and a lower socket 32. A disc 31 is mounted rotatably in the lower socket 32.

Figure 12:
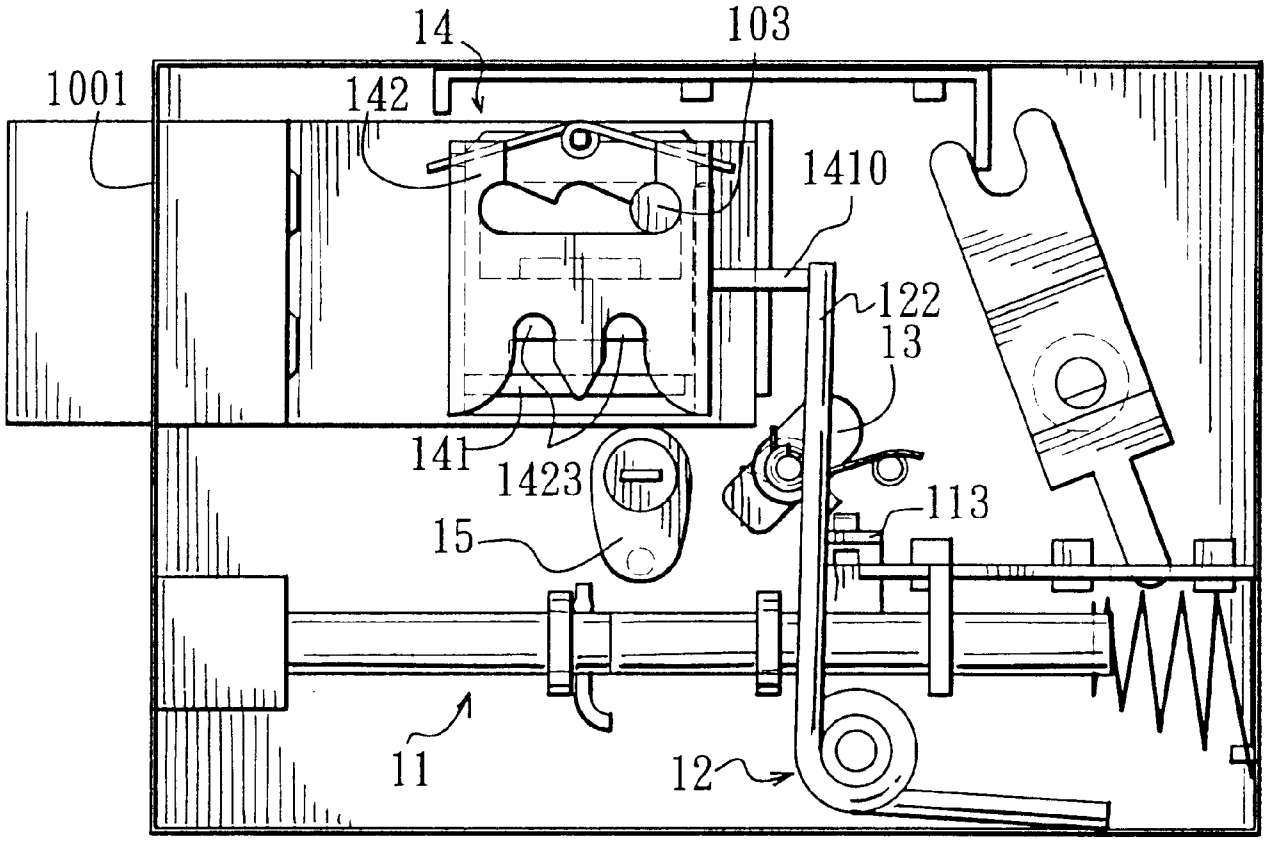
FIG. 12 illustrates the latch of the preferred embodiment of the door lock assembly in a latched position according to the present invention.

The casing 10 has left and right side walls 100, 106 that are opposite to one another, and a rear wall 108 interconnecting the left and right side walls 100, 106. The left side wall 100 has upper and lower openings 1001, 1002 formed therein. The latch 14 is mounted movably in the casing 10 in a latching direction as shown by the arrow (A) between a latched position as shown in FIG. 12 and an unlatched position as shown in FIG. 2. In the latched position, the latch 14 extends out of the upper opening 1001 of the casing 10. In the unlatched position, the latch 14 is retracted into the casing 10.

Figure 3:
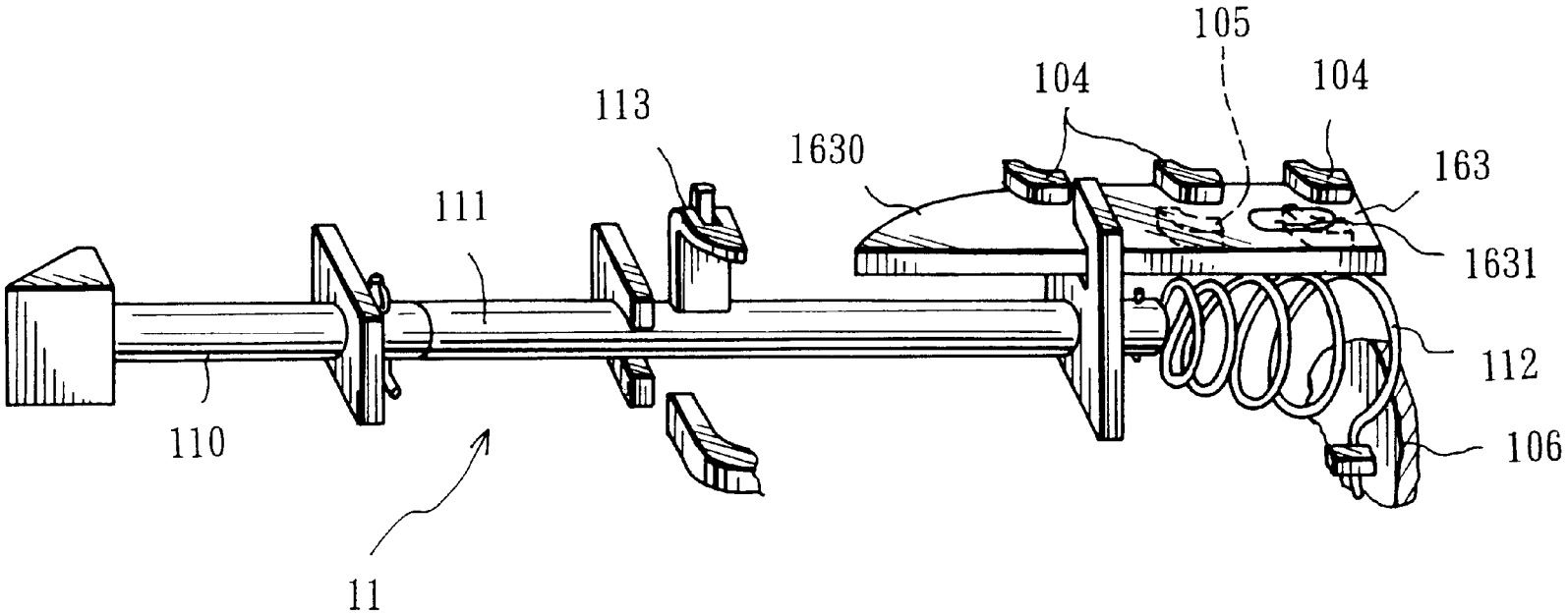
FIG. 3 is a perspective view of an actuator rod of the preferred embodiment of the door lock assembly according to the present invention.

Referring to FIGS. 2 and 3, the actuator rod 11 is disposed below the latch 14 and is movable in the casing 10 along a direction parallel to the latching direction (A) between an extended position outwardly of the casing 10 via the lower opening 1002 as shown in FIG. 2, and a retracted position as shown in FIG. 12. The actuator rod 11 has a first section 110 that is slidable but nonrotatable with respect to a longitudinal axis of the actuator rod 11, and a second section 111 that is connected rotatably to the first section 110 about the longitudinal axis of the actuator rod 11. The second section 111 of the actuator rod 11 has an actuating element 113 projecting radially therefrom. A coiled spring 112 has two opposed ends connected respectively to the second section 111 of the actuator rod 11 and the right side wall 106 to urge a distal end of the first section 110 of the actuator rod 11 to the extended position. When the door 2 is closed, the distal end of the first section 110 is pushed by the disc 31 in the lower socket 32 of the doorframe 3 and is retracted into the casing 10 against the spring force of the coiled spring 112, as best illustrated in FIG. 12. A horizontal plate 163 is mounted above the coiled spring 112 adjacent to the right side wall 106, and has an arcuate edge 1630 adjacent to the second section 111 of the actuator rod 11. One side of the horizontal plate 163 is sandwiched between two rows of positioning blocks 104, 105 that are fixed on the rear wall 108 in order to slide into the latching direction (A).

A first pillar 101 projects from the rear wall 108 below the actuator rod 11. A torsion spring member 12 has an intermediate loop portion 120 mounted on the first pillar 101, a first spring arm 121 abutting against an internal face of the casing 10, and a second spring arm 122 extending upwardly to the latch 14.

Figure 4:
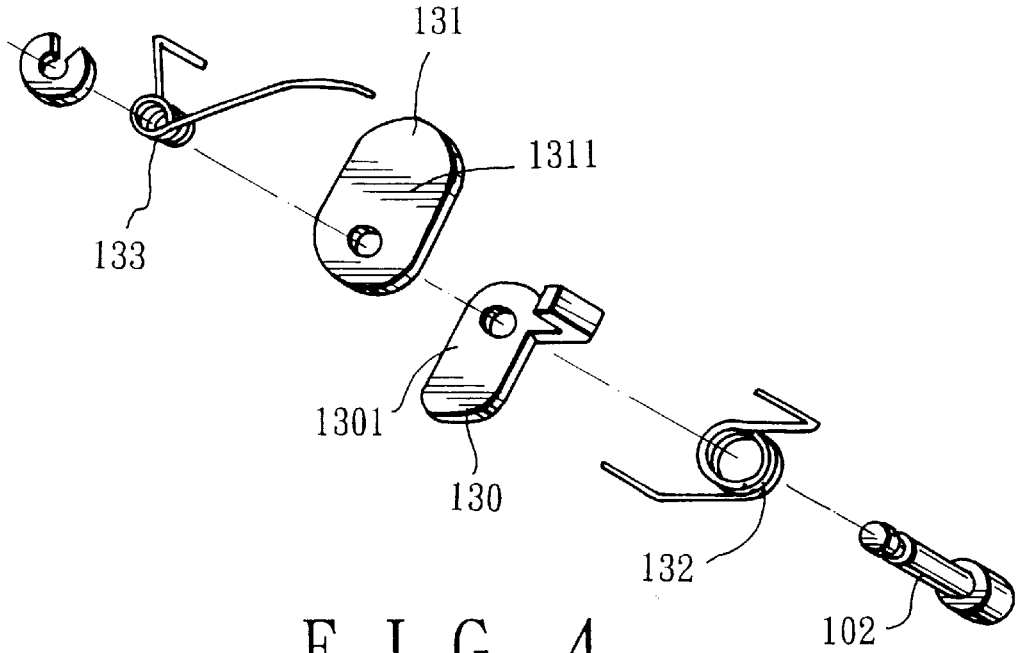
FIG. 4 is an exploded view of a spring-loaded lever member of the preferred embodiment of the door lock assembly according to the present invention.
Figure 5:
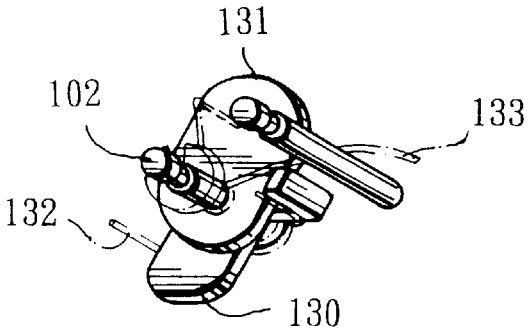
FIG. 5 is a perspective view of the spring-loaded lever member shown in FIG. 4.

The casing 10 further has a second pillar 102 projecting from the rear wall 108 thereof. A spring-loaded lever member 13 is mounted rotatably on the second pillar 102. The spring-loaded lever member 13 has upper and lower ends 131, 130 formed respectively on two eccentric members 1311, 1301 that are mounted on the second pillar 102, as best illustrated in FIGS. 4 and 5. The spring-loaded lever member 13 further has two return springs 132, 133 mounted thereto in order to bias the spring-loaded lever member 13 when the latter is rotated.

Figure 6:
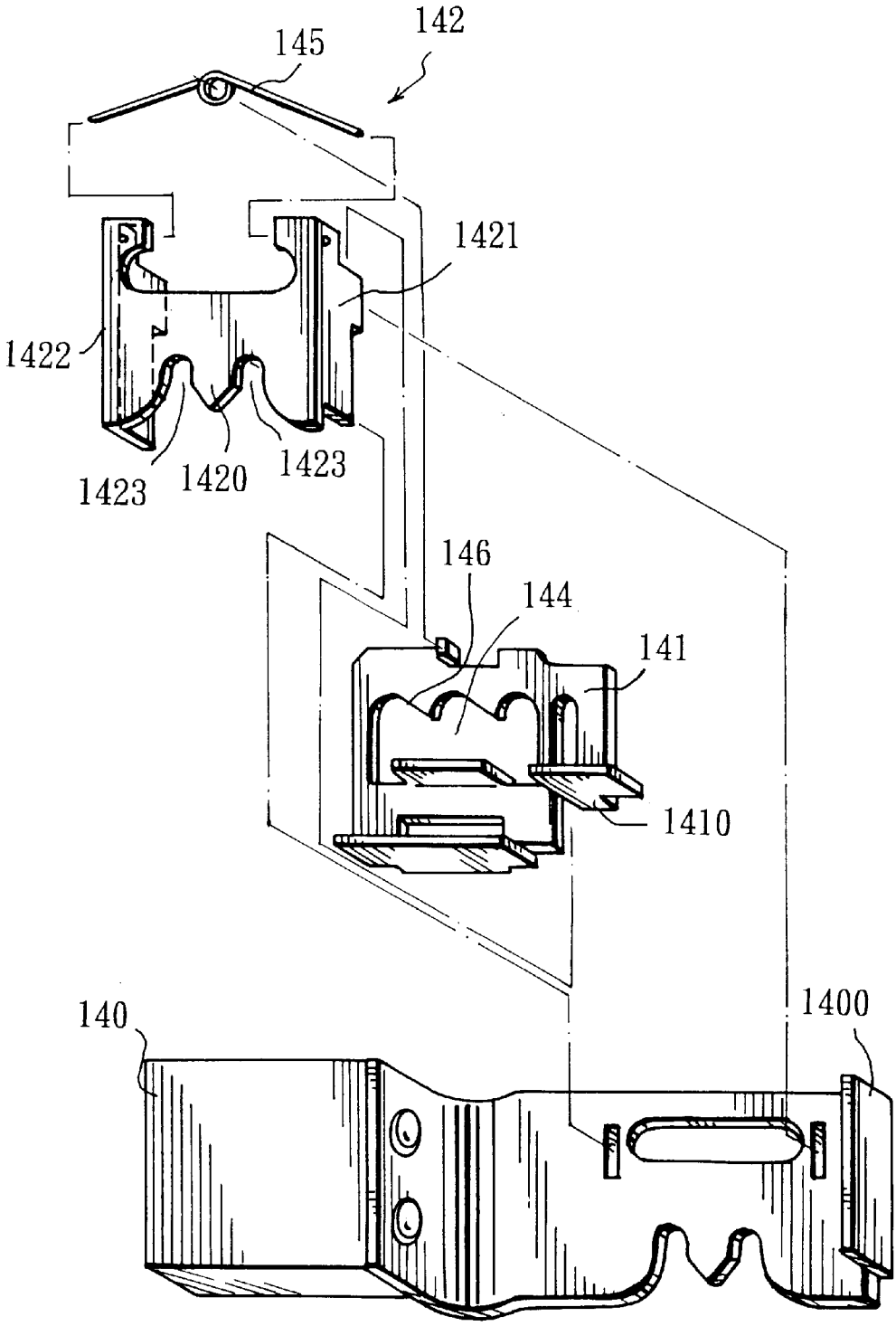
FIG. 6 is an exploded view of a latch of the preferred embodiment of the door lock assembly according to the present invention.
Figure 7:
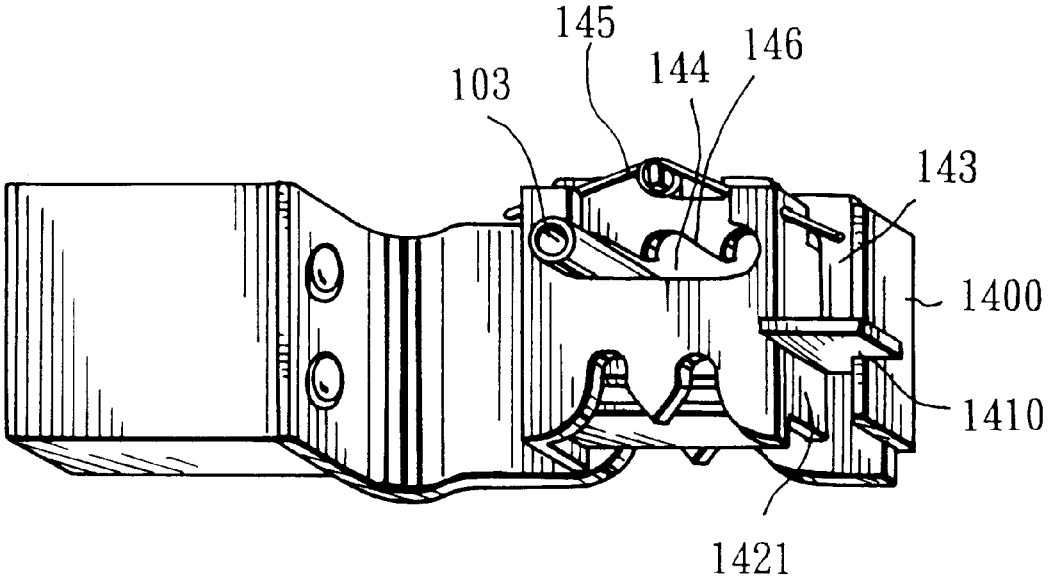
FIG. 7 is a perspective view of the latch shown in FIG. 6.

Referring to FIGS. 6 and 7, the latch 14 has an elongated body 140, a control plate 141, and a mounting plate 142. The elongated body 140 has a bent portion 1400 formed at an end thereof that is distal from the right side wall 106. The mounting plate 142 has a flat portion 1420 and two opposed bent portions 1421, 1422 formed on two sides of the flat portion 1420.

Figure 8:
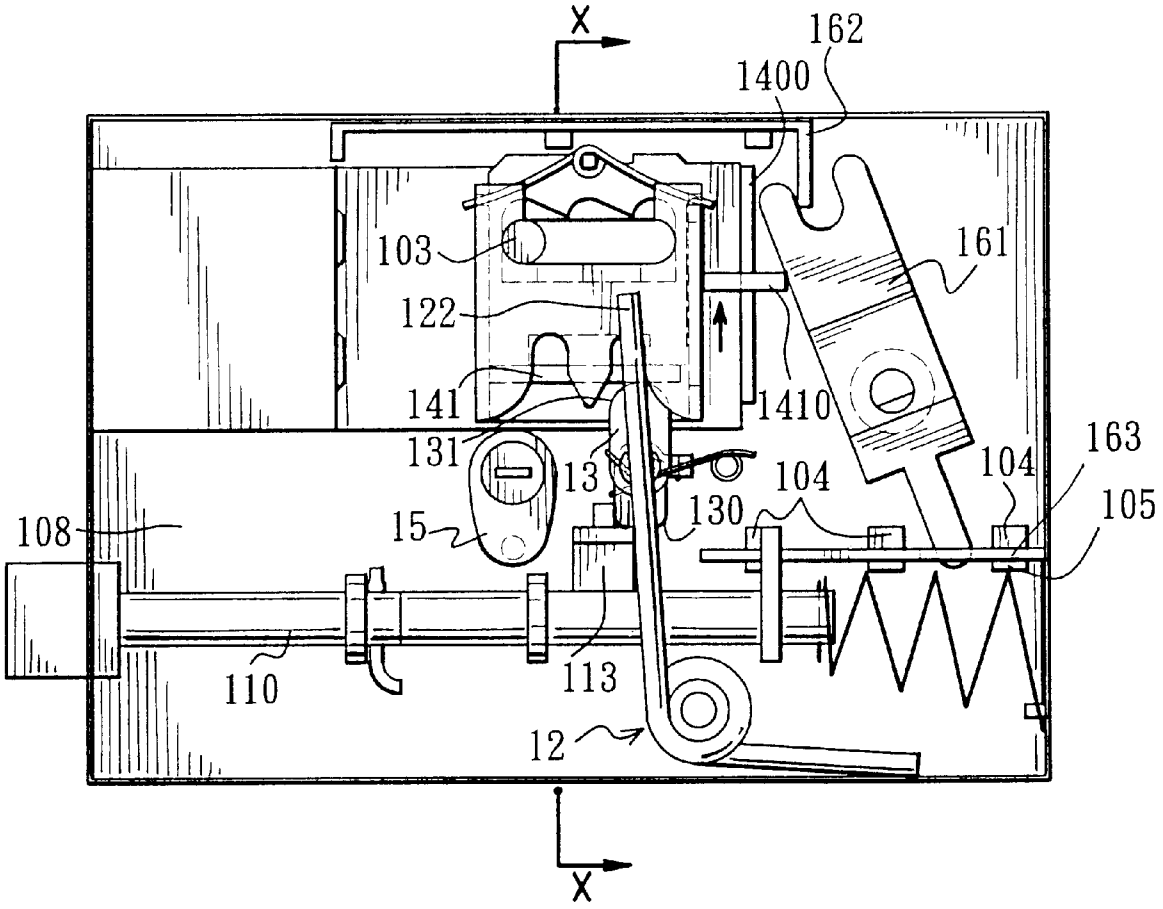
FIG. 8 illustrates the preferred embodiment of the door lock assembly in a first operative position according to the present invention.
Figure 9:
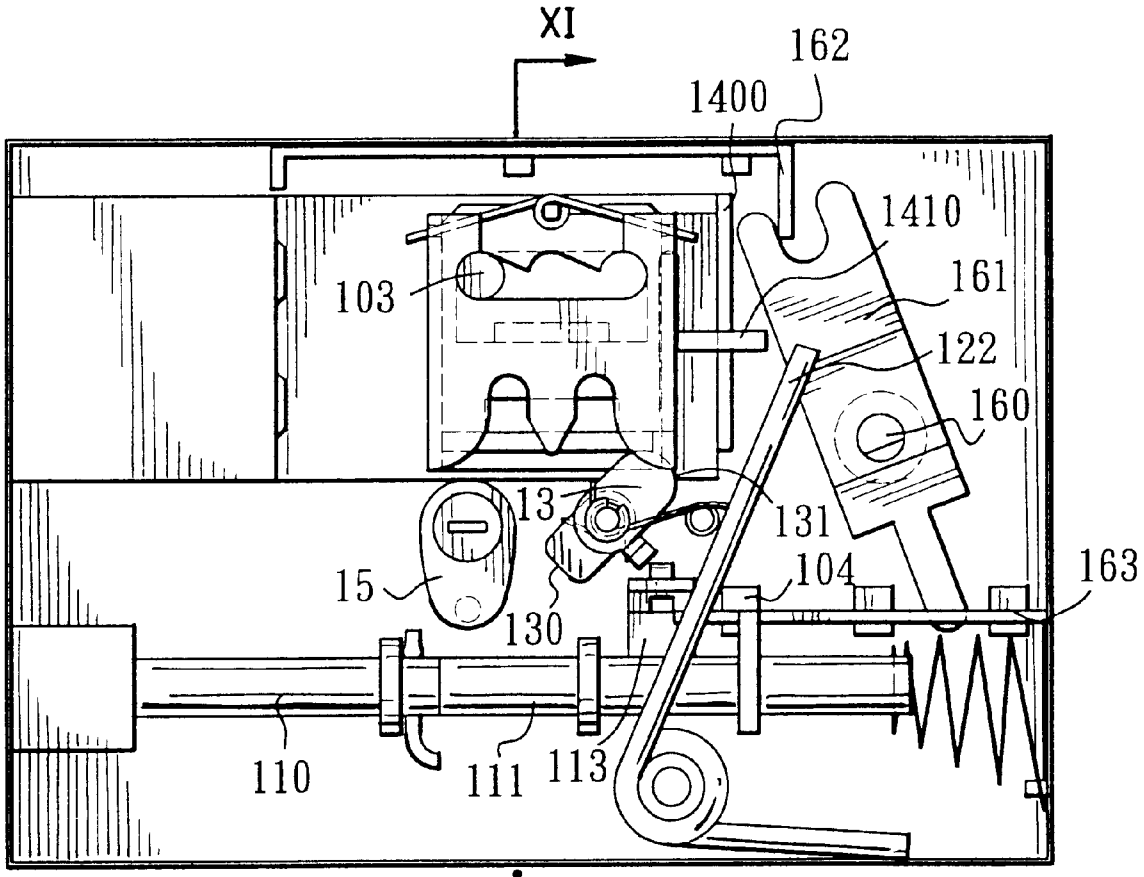
FIG. 9 illustrates the preferred embodiment of the door lock assembly in a second operative position according to the present invention.

The elongated body 140, the control plate 141 and the mounting plate 142 are mounted sequentially on a retention post 103 that projects from the rear wall 108. Specifically, the opposed bent portions 1421, 1422 of the mounting plate 142 are generally parallel to the bent portion 1400 of the elongated body 140, as best illustrated in FIG. 7. A gap 143 is formed between one of the opposed bent portions 1421 and the bent portion 1400. The control plate 141 is disposed between the elongated body 140 and the mounting plate 142 in such a manner that the control plate 141 is immobilized with respect to the elongated body 140 along the latching direction (A), and is movable between an upper position as shown in FIG. 8 and a lower position as shown in FIG. 9 in a direction transverse to the latching direction (A) and parallel to a plane of the rear wall 108 of the casing 10. A spring member 145 is connected to an upper edge of the mounting plate 142 and an upper edge of the control plate 141 to bias the control plate 141 to the lower position. The lower edge of the mounting plate 142 has two notches 1423 formed therein. The control plate 141 has an elongated slot 144 through which the retention post 103 extends, and a stopper 1410 projecting forwardly therefrom and sliding in the gap 143 when the control plate 141 moves up and down. A plurality of detent notches 146 are formed along an upper periphery of the slot 144. One of the detent notches 146 engages the retention post 103 when the control plate 141 is in the lower position in order to prevent the latch 14 from moving from the latched position to the unlatched position. The detent notch 146 disengages from the retention post 103 when the control plate 141 moves to the upper position. A top end of the second spring arm 122 of the torsion spring member 12 is higher than the stopper 1410 when the control plate 141 is in its lower position but is lower than the stopper 1410 when the control plate 141 is in its upper position.

Referring to FIG. 8, when the door 2 is closed to enable the first section 110 of the actuator 11 to be pushed by the disc 31 in the lower socket 32 of the doorframe 3 and to retract into the casing 10, the actuating member 113 pushes the lower end 130 of the spring-loaded lever member 13 to turn the spring-loaded lever member 13. The upper end 131 of the spring-loaded lever member 13 pushes the lower edge of the control plate 141 to move the control plate 141 from the lower position to the upper position. At this time, the actuating member 113 pushes simultaneously the second spring arm 122 to permit right movement of the second spring arm 122 against the spring force of the torsion spring member 12. Therefore, the top end of the second spring arm 122 can pass under the control plate 141 when the actuator rod 11 is moved from the extended position to the retracted position. After the second spring arm 122 passes over the stopper 1410, the actuating member 113 is disengaged from the lower end of the spring-loaded lever member 13 to permit the spring-loaded lever member 13 to return to its original position by means of the spring force of the return springs 132, 133, as best illustrated in FIG. 9.

Figure 10:
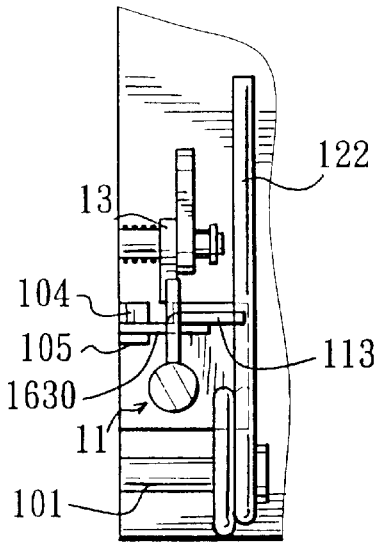
FIG. 10 is cross-sectional view taken along the line X—X of FIG. 8.
Figure 11:
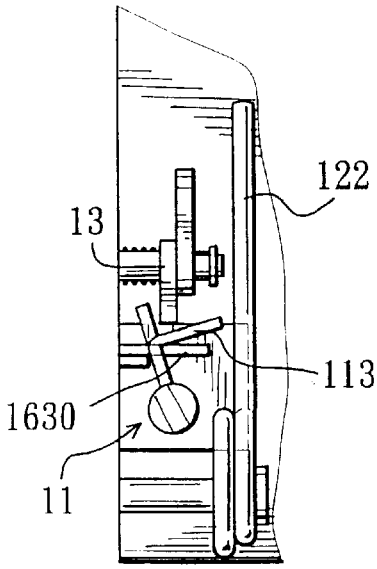
FIG. 11 is cross-sectional view taken along the line XI—XI of FIG. 9.

Referring to FIGS. 9 and 10, when the actuator rod 11 is further moved right, the actuating element 113 slides along the arcuate edge 1630 of the horizontal plate 163 to rotate the second section 111 of the actuator rod 11, thereby permitting disengagement of the actuating element 113 and the second spring arm 122 of the torsion spring member 12, as best illustrated in FIG. 11. As such, the second spring arm 122 can strike the stopper 1410 of the control plate 141 to move the latch 14 from the unlatched position to the latched position, as best illustrated in FIG. 12. At this time, the latch 14 can extend out of the casing 10 into the corresponding upper socket 30 in the doorframe 3 in order to lock the door 2 to the doorframe 3. In this way, the door 2 can be locked automatically by the latch 14 without employing a key when it is closed. The object of the present invention is thus met.

Figure 13:
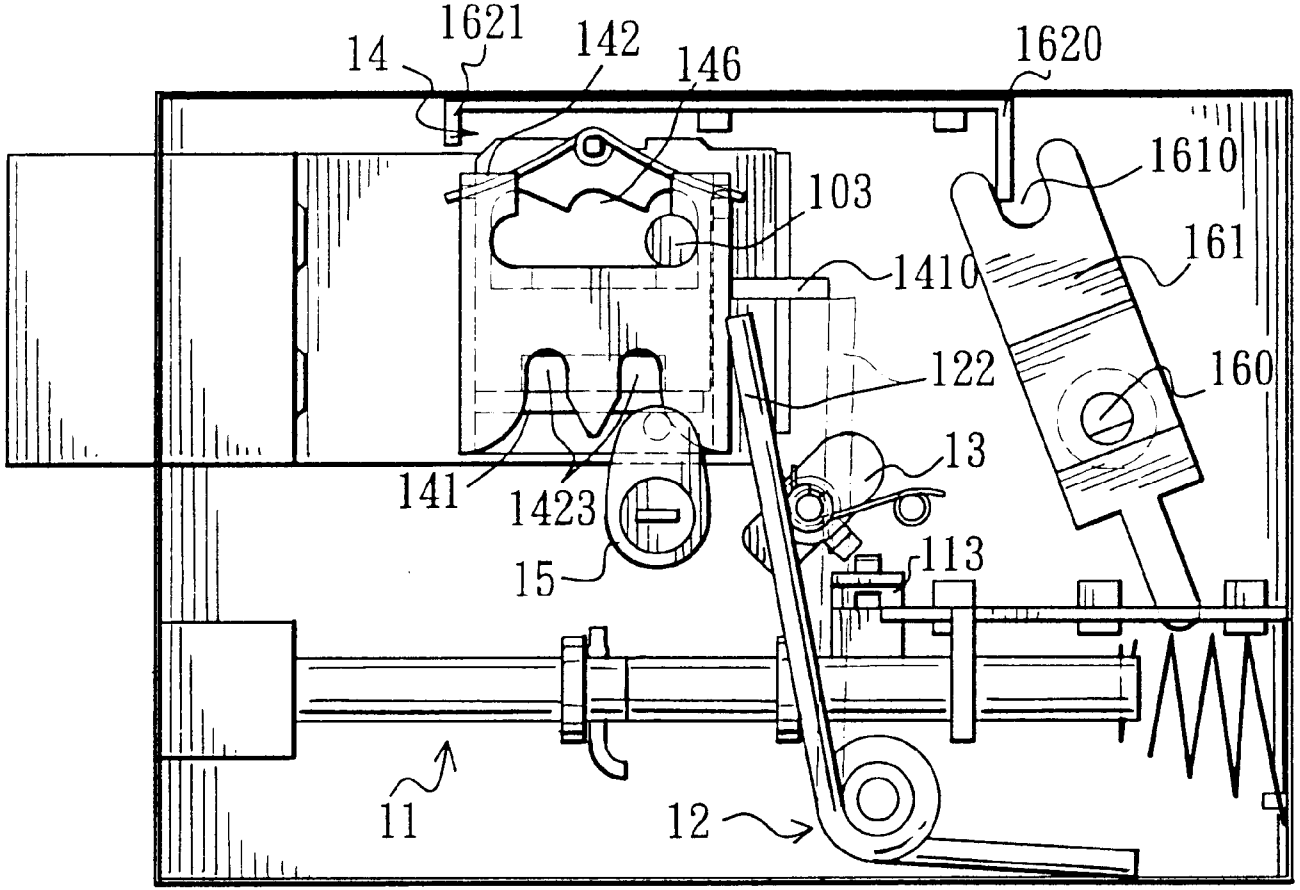
FIG. 13 is a view similar to that of FIG. 12, in which a control plate and the latch are pushed simultaneously by a key-operated member.

When it is desired to unlock the door 2, with reference to FIG. 13, a key (not shown) is inserted into a key-operated member 15 that is mounted rotatably on the rear wall 108 of the casing 10 to rotate the same. The key-operated member 15 pushes the control plate 141 to move from the lower position to the upper position, thereby permitting disengagement of the retention post 103 and the detent notches 146 and permitting disengagement of the second spring arm 122 and the stopper 1410. Then, the key-operated member 15 is further rotated to push the mounting plate 142 and, therefore, the latch 14 to the right, thereby moving the latch 14 from the latched position to the unlatched position, as best illustrated in FIG. 2.

Figure 14:
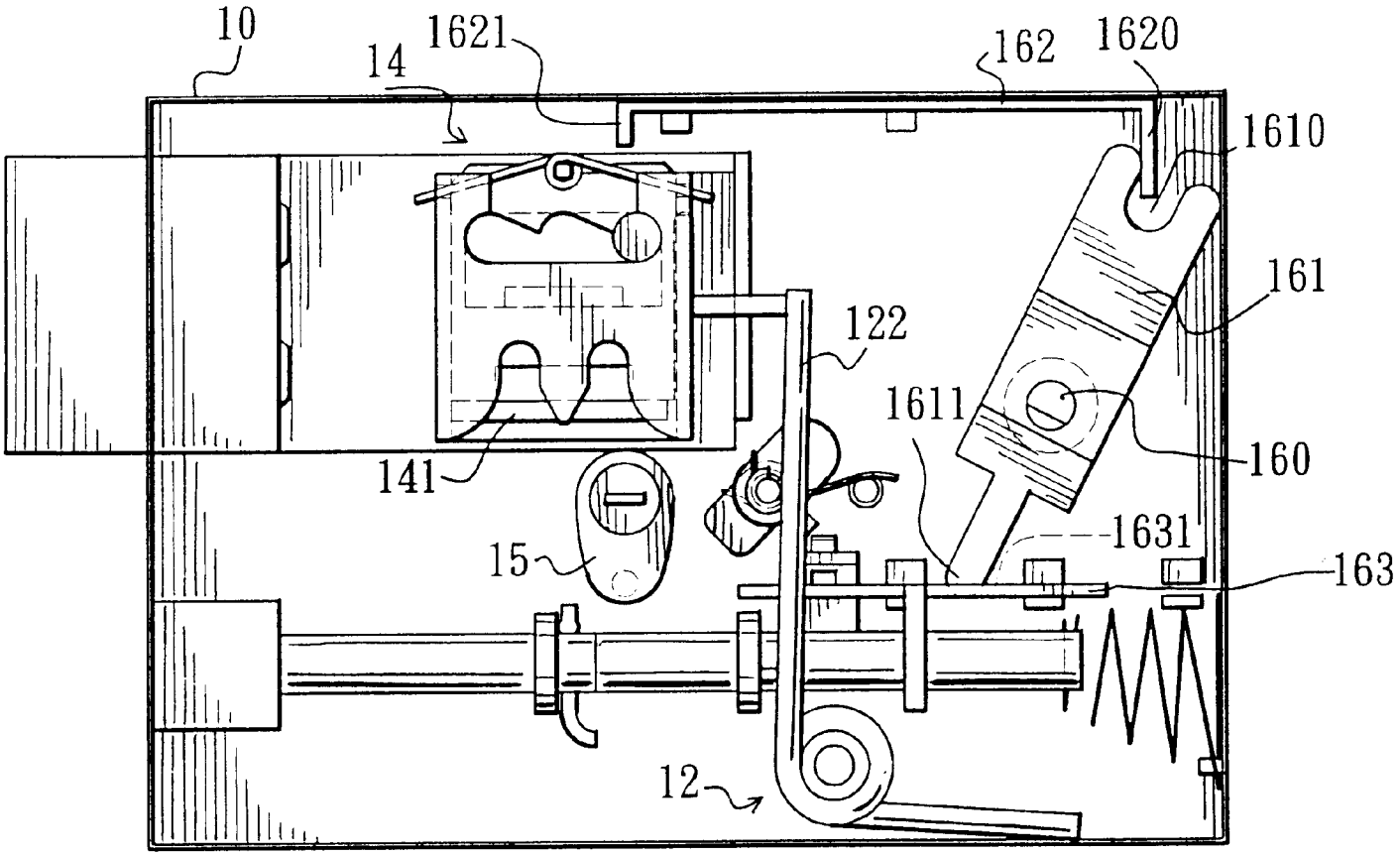
FIG. 14 is a view similar to that of FIG. 12, in which the control plate is prevented from being moved upwardly by a positioning mechanism.

Referring to FIG. 14, a positioning mechanism 16 is provided for positioning the latch 14 relative to the casing 10. The positioning mechanism 16 has a positioning lever 161 mounted on the rear wall 108 of the casing 10 and a positioning bar 162 disposed slidably above the latch 14. The positioning bar 162 has first and second downwardly extending end portions 1620, 1621. The positioning lever 161 has an upper end 1610 that engages the first downwardly extending end portion 1620 of the positioning bar 162, and a lower end 1611 that extends into a hole 1631 formed in the horizontal plate 163 (see FIG. 3). The positioning lever 161 is rotatable by a knob 160 mounted outwardly of the rear wall 108 of the casing 10 to move the positioning bar 162 to the right. The second downwardly extending end portion 1621 of the positioning bar 162 is then moved above an upper edge of the control plate 141 to prevent the control plate 141 from moving from the lower position to the upper position when the latch 14 is in the latched position.

Figure 15:
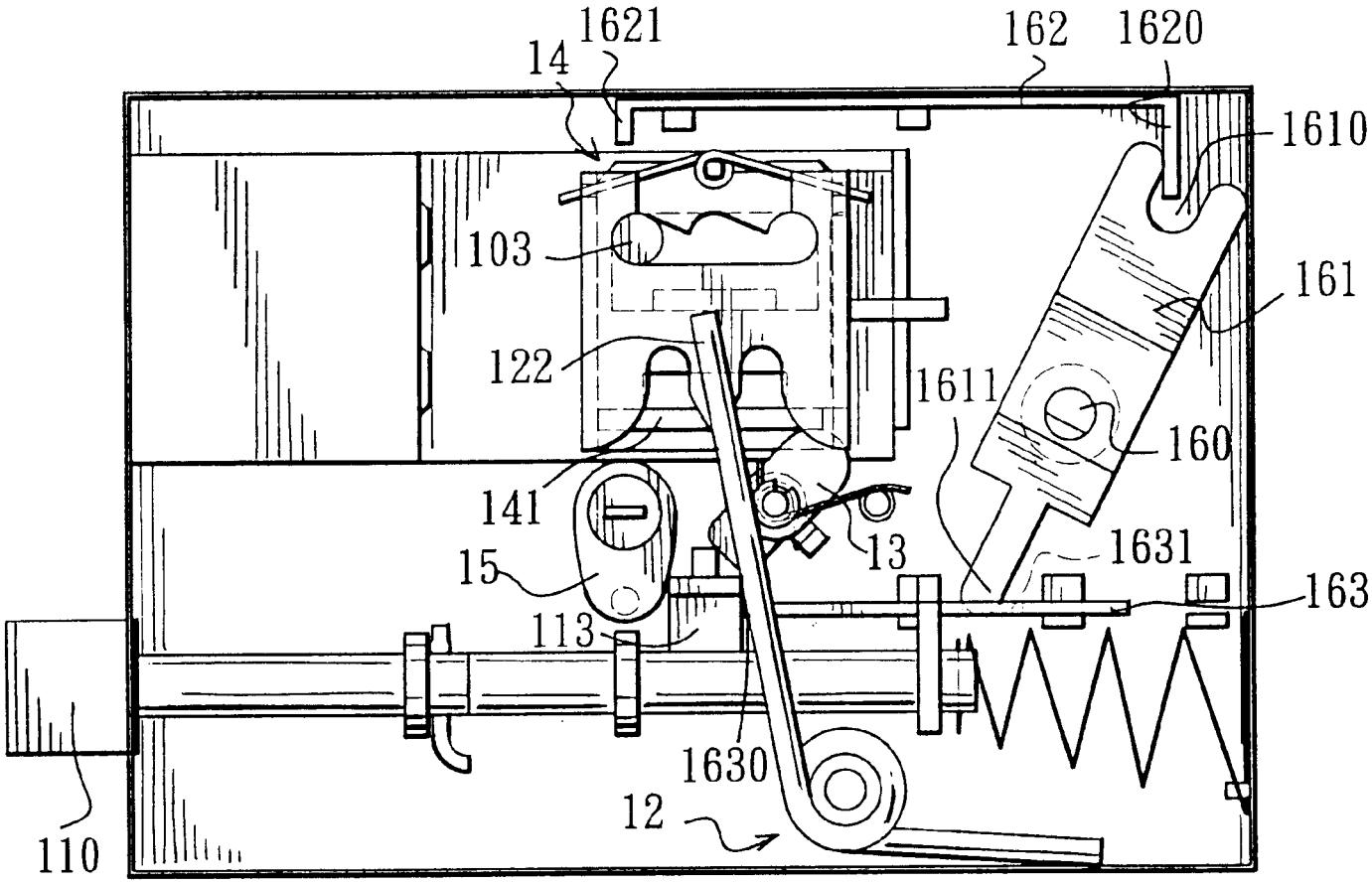
FIG. 15 is a view similar to that of FIG. 14, with the latch shown in an unlatched position and an actuator rod shown in an extended position.

Referring to FIG. 15, when the positioning lever 161 is rotated to prevent the control plate 141 from moving upwardly, the horizontal plate 163 is moved left by the lower end 1611 of the positioning lever 161. The actuator rod 11 is rotated as the actuating member 113 slides along the arcuate edge 1630 of the horizontal plate 163. Therefore, the actuator rod 11 can move from its extended position to its retracted position without interference from the spring-loaded lever member 13 and the second spring arm 122 of the torsion spring member 12. As such, the door 2 can be closed to the doorframe 3 without actuating the latch 14 to lock the door 2 to the doorframe 3.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A door lock assembly comprising a hollow casing having left and right side walls that are opposite to one another, and a rear wall interconnecting said left and right side walls, said left side wall having upper and lower openings formed therein:

a latch mounted movably in said casing in a latching direction between a latched position for allowing extension of said latch out of said casing via said upper opening and an unlatched position for allowing retraction of said latch into said casing;

an actuator rod disposed below said latch and movable in said casing along a direction parallel to said latching direction between an extended position outwardly of said casing via said lower opening and a retracted position, said actuator rod having an actuating element formed thereon, and a coiled spring for urging said actuator rod to said extended position;

a drive mechanism actuated by said actuating element when said actuator rod is moved to said retracted position against a spring force of said coiled spring for driving said latch to said latched position;

said latch having a control plate mounted thereon, and said control plate being immobilized with respect to said latch along said latching direction, and being movable between an upper position and a lower position in a direction transverse to said latching direction and parallel to a plane of said rear wall of said casing;

and said door lock assembly further having a retention post extending from said rear wall to said latch, said control plate having an elongated slot through which said retention post extends, and detent means provided adjacent to said slot, said detent means engaging said retention post in order to prevent said latch from moving from said latched position to said unlatched position when said control plate is in said lower position, and said detent means disengaging from said retention post when said control plate is in said upper position.

2. The door lock assembly as claimed in claim 1, further comprising a positioning mechanism having a positioning lever mounted on said rear wall of said casing and a positioning bar disposed slidably above said latch, said positioning bar having first and second downwardly extending end portions, said positioning lever having an upper end that engages said first downwardly extending end portion of said positioning bar, said positioning lever being rotatable to move said second downwardly extending end portion of said positioning bar above an upper edge of said control plate in order to prevent said control plate from moving from said lower position to said upper position when said latch is in said latched position.

3. The door lock assembly as claimed in claim 2, further comprising an unlocking device having a key-operated member mounted rotatably on said rear wall of said casing, said key-operated member pushing said control plate to move from said lower position to said upper position, and then pushing said latch to move from said latched position to said unlatched position.

4. A lock assembly comprising a hollow casing having left and right side walls that are opposite to one another, and a rear wall interconnecting said left and right side walls, said left side wall having upper and lower openings formed therein;

a latch mounted movably in said casing in a latching direction between a latched position for allowing extension of said latch out of said casing via said upper opening and an unlatched position for allowing retraction of said latch into said casing;

an actuator rod disposed below said latch and movable in said casing along a direction parallel to said latching direction between an extended position outwardly of said casing via said lower opening and a retracted position,said actuator rod having an actuating element formed thereon, and a coiled spring for urging said actuator rod to said extended position;

a drive mechanism actuated by said actuating element when said actuator rod is moved to said retracted position against a spring force of said coiled spring for driving said latch to said latched position;

said latch having a control plate mounted thereon, and said control plate being immobilized with respect to said latch along said latching direction, and being movable between an upper position and a lower position in a direction transverse to said latching direction and parallel to a plane of said rear wall of said casing; and said drive mechanism comprises a torsion spring member disposed adjacent to said actuator rod and having a spring arm that is actuated by said actuating element to cause said latch to move from said unlatched position to said latched position when said actuator rod is moved from said extended position toward said retracted position; and said lock assembly further having a spring-loaded lever member disposed between said latch and said actuator rod, and having an upper end abutting against a lower edge of said control plate, and a lower end that is pushed by said actuating element to turn said spring-loaded lever member when said actuator rod is moved from said extended position toward said retracted position, said upper end of said spring-loaded lever member pushing said control plate to move from said lower position to said upper position and then back to said lower position when said spring-loaded lever member is turned.

5. The door lock assembly as claimed in claim 4, wherein said control plate has a stopper projecting forwardly therefrom, said spring arm extending upwardly to said latch and having a top end that is higher than said stopper on said control plate, said top end of said spring arm passing under said stopper when said actuator rod moves from said extended position to said retracted position to bias said spring arm and to move said control plate from said lower position to said upper position.

6. The door lock assembly as claimed in claim 5, wherein said actuator rod has a first section that is slidable but nonrotatable with respect to a longitudinal axis of said actuator rod, and a second section that is connected rotatably to said first section about said longitudinal axis of said actuator rod.

7. The door lock assembly as claimed in claim 6, wherein said torsion spring member is positioned below said actuator rod adjacent to said second section of said actuator rod.

8. The door lock assembly as claimed in claim 7, wherein said coiled spring has two opposed ends connected respectively to said second section of said actuator rod and said right side wall.

9. The door lock assembly as claimed in claim 8, further comprising a horizontal plate mounted adjacent to said right side wall of said casing and having an arcuate edge, said actuating element projecting radially from said actuator rod and being slidable along said arcuate edge of said horizontal plate to rotate said second section of said actuator rod and to permit said actuating element to disengage from said spring arm of said torsion spring member, thereby allowing said spring arm to strike said stopper of said control plate to move said latch from said unlatched position to said latched position.

* * * * *